US005466399A

United States Patent [19]

Von Kempski et al.

[11] Patent Number: 5,466,399

[45] Date of Patent: Nov. 14, 1995

[54] PROCESS, INSTALLATION AND DEVICE FOR ENRICHING VENTILATION OR AIR-CONDITIONING AIR WITH AROMATIC SUBSTANCES

[76] Inventors: Diotima Von Kempski, Backergasse 2, D-4000 Dusseldorf 1; Wolfgang H. Mahl, Cyriakusstrasse 4, D-41462 Neuss, both of Germany

[21] Appl. No.: 339,458

[22] Filed: Nov. 14, 1994

Related U.S. Application Data

[63] Continuation-in-part of Ser. No. 941,038, Dec. 10, 1992, abandoned.

[30] Foreign Application Priority Data

Apr. 10, 1990 [DE] Germany ..... 40 11 5143

[51] Int. Cl.[6] ..... B01F 3/04

[52] U.S. Cl. ..... 261/27; 261/72.1; 261/119.1; 261/DIG. 65; 261/DIG. 74; 422/124

[58] Field of Search ..... 261/DIG. 65, 119.1, 261/27, 72.1, DIG. 74; 422/124

[56] References Cited

U.S. PATENT DOCUMENTS

| | | | |
|---|---|---|---|
| 1,121,845 | 12/1914 | Kallusch | 422/124 |
| 1,323,800 | 12/1919 | Walker et al. | 422/124 |
| 1,567,957 | 12/1925 | Kesselman | 422/124 |
| 2,686,944 | 8/1954 | Gubelin | 422/124 |
| 3,158,081 | 11/1964 | Frost | 261/27 |
| 3,298,674 | 1/1967 | Gilbertson | 261/30 |
| 3,442,602 | 5/1969 | Diehl . | |
| 3,490,436 | 1/1970 | Hart | 261/DIG. 65 |
| 3,599,841 | 8/1971 | Thompson | 261/30 |
| 4,067,692 | 1/1978 | Ferris | 261/DIG. 65 |
| 4,601,886 | 7/1986 | Hudgins | 261/DIG. 65 |
| 4,679,943 | 7/1987 | Kavoussi et al. | 261/DIG. 65 |
| 5,023,020 | 6/1991 | Machida et al. | 261/DIG. 65 |
| 5,030,253 | 7/1991 | Tokuhiro et al. | 261/DIG. 65 |
| 5,105,133 | 4/1992 | Yang | 422/124 |
| 5,174,967 | 12/1992 | Fukuhara | 422/124 |
| 5,302,359 | 4/1994 | Nowatzki | 261/27 |

FOREIGN PATENT DOCUMENTS

| | | | |
|---|---|---|---|
| 2448930 | 10/1980 | France | 422/124 |
| 1674979 | 3/1954 | Germany . | |
| 1265953B | 7/1968 | Germany . | |
| 2740476 | 3/1979 | Germany . | |
| 62-49138 | 3/1987 | Japan | 261/DIG. 65 |

OTHER PUBLICATIONS

New Collegiate Dictionary, Apr. 1977, p. 374, G&C Merriam Co., Springfield Mass.

*Primary Examiner*—Tim R. Miles

*Attorney, Agent, or Firm*—Tarolli, Sundheim & Covell

[57] ABSTRACT

In a process, installation and device for enriching ventilation or air-conditioning air with aromatic substances, the enrichment is homogenized in that a mixture of preferably water and aromatic substance is produced and stocked in a container (11) having a free evaporation surface for the mixture. The intake air current of the ventilation or air-conditioning air or part thereof is taken over the free evaporation area and then fed into the air-conditioning system.

23 Claims, 4 Drawing Sheets

PROCESS, INSTALLATION AND DEVICE FOR ENRICHING VENTILATION OR AIR-CONDITIONING AIR WITH AROMATIC SUBSTANCES

This is a continuation-in-part of application Ser. No. 07/941,038, filed Dec. 10, 1992, now abandoned.

BACKGROUND OF THE INVENTION

1. Technical Field

The invention pertains to a process, installation and device for enriching ventilation or air-conditioning air with aromatic substances.

2. Background Art

The addition of fragrances into ventilation or air-conditioning air by spraying of a fine mist is known, in order to create a pleasant aroma in the artificially ventilated or air-conditioned room. This method has the disadvantage that a permanent spraying is not feasible for various reasons, and a timed or interval operation of the spraying of fragrances can lead to tangible fluctuations in fragrance concentration in the artificially ventilated or air-conditioned area.

From DE 12 65 953 B a humidifier for air-conditioning systems is known, where the air flow to be moistened is directed onto the liquid surface of a water droplet catch vessel and a nozzle spraying the humidifying water into the air stream is directed above the sloped air stream at a slant to the water surface. This known humidifying device has the above-mentioned disadvantages of water spraying and, in addition, is intended primarily for humidifying purposes and not for the addition of fragrances.

From U.S. Pat. No. 3,599,841 a device is known for the circulation of air under simultaneous enrichment with a fragrance, where a vessel holding the fragrance is connected to a channel with flowing circulating air (by the use of an inlet and an outlet valve), so that the circulating air (with valves opened) is fed as a whole through the vessel holding the fragrance, while with the valves closed, the flow channel for the circulating air will also be interrupted by the double seat valve for additional fluid flow. The disadvantage of this known device consists in the fact that it does not allow a permanent ventilation or air-conditioning, since the air flow is interrupted periodically. In addition, the forced circulation of the air through the vessel holding the fragrance leads to a far greater enrichment of the air flow with fragrance, which is perceived as unpleasant by persons using the room ventilated in this way-in particular in connection with the merely cyclical operation of the device. Since this known device must rely on the use of double seat valves in order to prevent evaporation of the relatively fast evaporating fragrance during periods of interrupted air circulation, it is also not possible to use this device in another manner than per the on/off cycle principle. Of course, this publication mentions the possibility that double seat valves will open not only entirely, but also partly, or that the fan air stream can be varied, but these possibilities do not mean that the evaporation of the fragrance will be retarded in this manner. Rather, the result of these kinds of attempts to retard the circulating air flow will be that the same quantity of air unit will be put out and that merely the air flow transporting the fragrance is weaker. Due to measures of this type, the concentration of fragrance will increase even more, which is not desirable.

From DE-GM 16 74 979 an air-conditioning system is known for the improvement of room air, where again, nozzles are used in order to add a liquid to the air-conditioning air, which has the property to absorb odorous and pungent substances present in the air-conditioning air. This known air-conditioning system has at its core the same disadvantages as those of the device described in conjunction with DE 12 65 953 B.

SUMMARY OF THE INVENTION

The invention is based on the problem of making the enrichment of air-conditioning or ventilation air with fragrances more uniform. The invention makes possible a completely uniform enrichment of the ventilation or air-conditioning air during the entire period of time desired. This time span is normally identical with the daily operating time of the ventilation or air-conditioning system. But it is also possible to enrich the ventilation or air-conditioning air with fragrance only during preset time intervals. This is possible in cases when only a partial flow of the ventilation or air-conditioning air is to be fed over the free evaporation surfaces of the fragrance enrichment vessel, e.g., so that this partial stream can flow only during the predetermined time intervals and during the other time intervals it is blocked, so that the entire, preferably intake air stream of the ventilation or air-conditioning air will be passed through a main intake pipe.

In the sense of the invention, "ventilation or air-conditioning air" means that we are dealing both with fresh air and also with circulation air, and also with mixtures of the two.

If barrier valves are being opened and closed or can be throttled for a partial air flow to be fed through the vessel in a cycle, then the partial air flow enriched with fragrances can also be controlled with regard to its rate of flow. Thus the concentration of fragrances in the ventilation or air-conditioning air is controllable in a simple manner.

Another possibility of performing the enrichment with fragrances only during a time interval consists in the fact that within the vessel having the evaporation surfaces, the possibility is provided that the intake air stream or partial intake air stream optionally comes into or out of contact with the evaporation surfaces. This is possible because of moving air guide surfaces, such as slides, flaps etc., if they can direct the air stream alternatively across the free evaporation surfaces or across a correspondingly sized, parallel circuited air channel.

Another alternative for the enrichment of the ventilation or air-conditioning air only during specified time intervals consists in that the vessel holding the evaporation surfaces contains fragrances only during these time intervals. Of course it is also possible to set the time intervals in sequence with differing fragrance accents. This can be done preferably by the use of several, in particular parallel-circuited (with regard to the air flow) vessels according to this invention.

Now in order to take account in particular of the health requirements of a ventilation or air-conditioning system, it is provided that the vessel having evaporation surfaces is drained, cleaned and refilled at specified time intervals. In order to achieve a thorough mixing between fragrance and dilution liquid during filling, the vessel is filled with mixture according to the sequence of adding a portion of the dilution liquid, adding fragrance, and adding the remainder of the dilution liquid. A particularly simple and effective means for mixing and also for cleaning of the vessel is to use a spray device for the dilution liquid.

In order to promote a particularly pronounced fragrance propagation, it is favorable that the mixture of dilution liquid and fragrance is kept at a particular temperature (preferably above room temperature). By means of a temperature control, the concentration of the fragrance can be changed within certain limits in the ventilation or air-conditioning air.

A device according to this invention is provided for enrichment of ventilation or air-conditioning air with fragrance, in which the ventilation or air-conditioning air is moved by a fan, in particular by intake, into a distributor system. A device suitable for enrichment of ventilation and air-conditioning air with fragrances solves the problem underlying the invention.

Expedient configurations of the article of the invention, that will ensure in particular a simple production, automated operation, good cleaning potential or adaptability to the particular applications, are disclosed.

The components or process steps mentioned above and also those claimed and described in the sample design per the invention, are not subject to any special exception conditions with regard to size, material selection and technical design or process conditions, so that the selection criteria known for the particular area of application can be used without restriction.

In accordance with one aspect of the present invention, a method for the enrichment of ventilation or air-conditioning air with a fragrance comprises the steps of providing a ventilation or air-conditioning air stream, providing a mixture of a fragrance and a dilution liquid for the fragrance, positioning the mixture in at least one vessel wherein the mixture has a free evaporation surface, feeding an induced air flow across the free evaporation surface of the mixture for evaporation of fragrance from the mixture into the induced air flow, combining the induced air flow with the ventilation or air-conditioning air stream in an amount which is a fraction of the ventilation or air-conditioning air stream, and controlling the quantity of the induced air flow across the free-evaporation surface per unit of time in response to sensored process data.

In accordance with another aspect of the present invention, a method for the enrichment of ventilation or air-conditioning air with a fragrance comprises the steps of providing a ventilation or air-conditioning air stream, providing a mixture of a fragrance and a dilution liquid for the fragrance, positioning the mixture in at least one vessel wherein the mixture has a free evaporation surface, feeding an induced air flow across the free evaporation surface of the mixture for evaporation of fragrance from the mixture into the induced air flow, and redosing the vessel with the mixture at selectable time points in response to sensored process data by (i) first draining old mixture still contained in the vessel out of the vessel, (ii) cleaning the vessel, and (iii) then dosing both fresh dilution liquid and fresh fragrance into the vessel.

In accordance with another aspect of the present invention, a method for the enrichment of ventilation or air-conditioning air with a fragrance comprises the steps of providing a ventilation or air-conditioning air stream, providing a mixture of a fragrance and a dilution liquid for the fragrance, positioning the mixture in at least one vessel wherein the mixture has a free evaporation surface, feeding an induced air flow across the free evaporation surface of the mixture for evaporation of fragrance from the mixture into the induced air flow. At least one vessel contains the fragrance only during time periods and/or that it contains different fragrances during different partial time periods by the use of several containers.

In accordance with another aspect of the present invention, a method for the enrichment of ventilation or air-conditioning air with a fragrance comprises the steps of providing a ventilation or air-conditioning air stream, providing a mixture of a fragrance and a dilution liquid for the fragrance, positioning the mixture in at least one vessel wherein the mixture has a free evaporation surface, feeding an induced air flow across the free evaporation surface of the mixture for evaporation of fragrance from the mixture into the induced air flow, combining the induced air flow with the ventilation or air-conditioning air stream in an amount which is a fraction of the ventilation or air-conditioning air stream, controlling the quantity of the induced air flow across the free-evaporation surface per unit of time in response to sensored process data, redosing the vessel with the mixture at selectable time points in response to sensored process data by (i) first draining old mixture still contained in the vessel out of the vessel, (ii) cleaning the vessel, and (iii) then dosing both fresh dilution liquid and fresh fragrance into the vessel, and controlling the temperature of the mixture in the vessel to maintain the temperature at a selectable value above room temperature.

In accordance with still another aspect of the present invention, a system is provided for the enrichment of ventilation or air-conditioning air with a fragrance. The system comprises a circuit for the ventilation or air-conditioning air. At least one vessel contains a mixture of fragrance and dilution liquid. The mixture defines a free evaporation surface in the vessel. A first fluid inlet means includes a valve connected to the vessel for introducing fresh dilution liquid into the vessel. A second fluid inlet means includes a pump connected to the vessel for introducing fresh fragrance into the vessel. Means is provided for inducing an air flow across the free evaporation surface. Means is provided for combining the induced air flow with the ventilation or air conditioning air. Means is provided for draining old mixture still contained in the vessel out of the vessel. Means is provided for cleaning the vessel after the vessel has been drained. Means responsive to sensored process data is provided for controlling the draining means, the cleaning means, and the first and second fluid inlet means to first drain and clean the vessel and then to dose both fresh dilution and fresh fragrance into the vessel after the vessel has been drained and cleaned. Means is provided for controlling the temperature of the mixture in the vessel to maintain the temperature at a selectable value above room temperature.

In accordance with still another aspect of the present invention, a system is provided for the enrichment of ventilation or air-conditioning air with fragrance. The system comprises at least one vessel containing a mixture of fragrance and diluting liquid. The mixture defines a free evaporation surface in the vessel. At least one pump connected in fluid communication with the vessel is provided for automatic closing of fragrance into the vessel. At least one valve connected in fluid communication with the vessel is provided for automatic dosing of dilution fluid into the vessel. The vessel includes (i) means defining at least one inlet air opening and (ii) means defining at least one outlet air opening. A fan having an intake side is provided for ventilation or air-conditioning air. Means responsive to sensored process data is provided for connecting the at least one outlet air opening in the vessel in fluid communication with the intake side of the fan to allow the fan to induce an air flow through the at least one inlet air opening across the free evaporation surface and then through the at least one outlet air opening to enrich the ventilation or air-conditioning air at the intake side of the fan with fragrance.

BRIEF DESCRIPTION OF THE DRAWINGS

Additional details, properties and advantages of the article of the invention arise from the following description of the attendant figures, in which preferred designs of the invented system and of an invented device for enrichment of ventilation or air-conditioning air with fragrances is presented in the figures and will be described in more detail below.

DETAILED DESCRIPTION OF PREFERRED EMBODIMENTS

Figure 2:
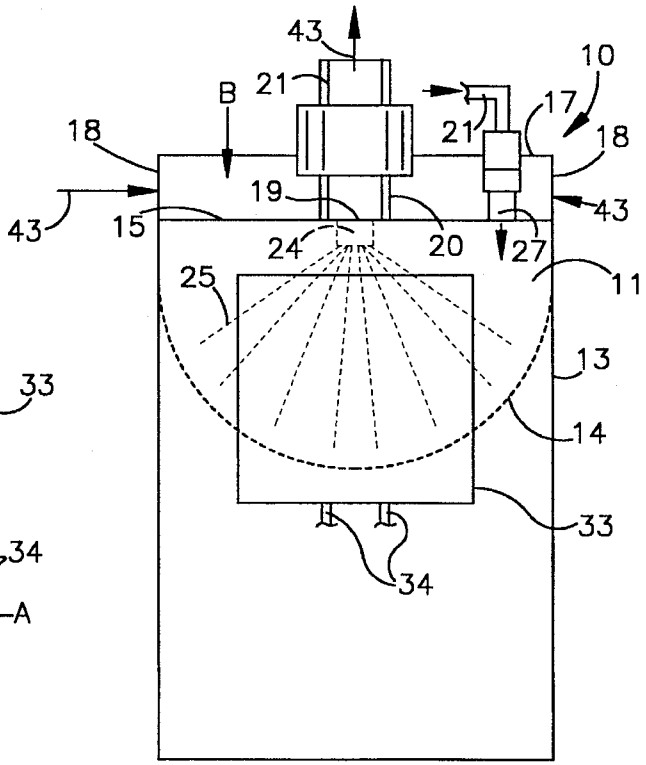
FIG. 2: The same device, front view of the vessel (view A according to FIG. 1)
Figure 1:
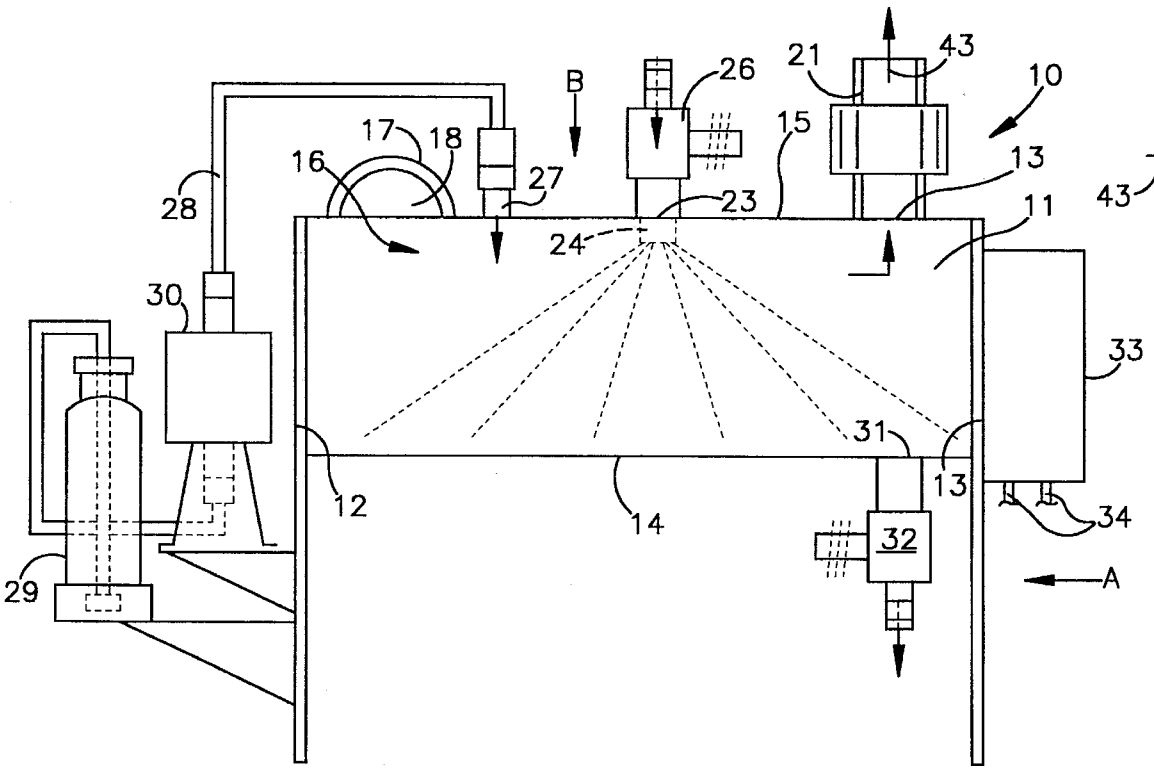
FIG. 1: A device for the enrichment of ventilation or air-conditioning air with fragrances, side view (schematic)
Figure 3:
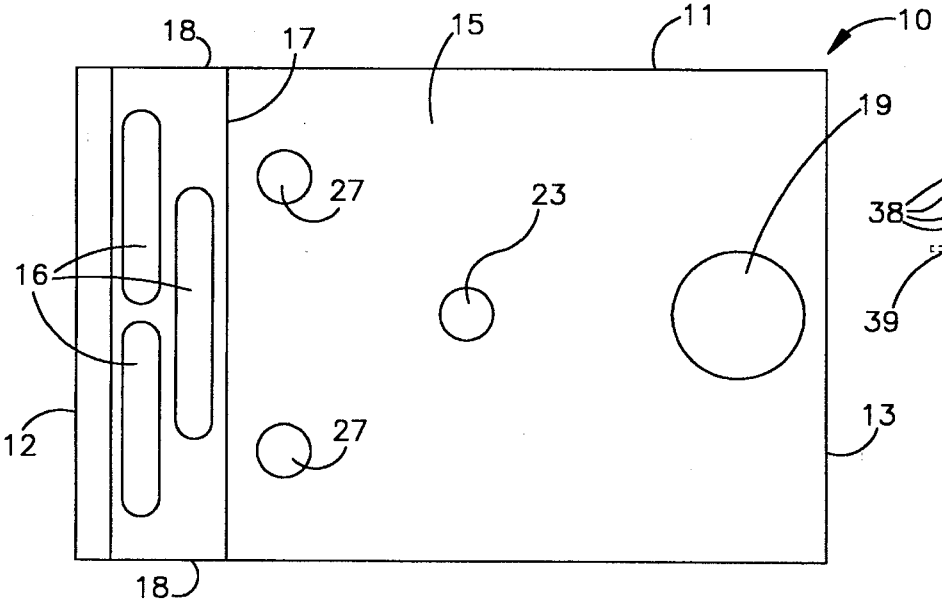
FIG. 3: The same device, top view (view B according to FIGS. 1 and 2), but without details of the accessories and attachments.

In FIGS. 1 to 3, the device 10 for the enrichment of ventilation or air-conditioning air with fragrances is illustrated in various views. It has a vessel 11 that is surrounded by front walls 12, 13, a cylindrical base tub 14 and a flat cover plate 15.

The elongated, transparent cover plate 15 has several elongated air feed openings 16 in the area of its one narrow side. These openings are protected from above with a semi-circular dust protection unit 17 against the penetration of dust or similar material settling down from the outside. The infeed air can enter at the open front surfaces 18 of the dust protective device 17.

Figure 4:
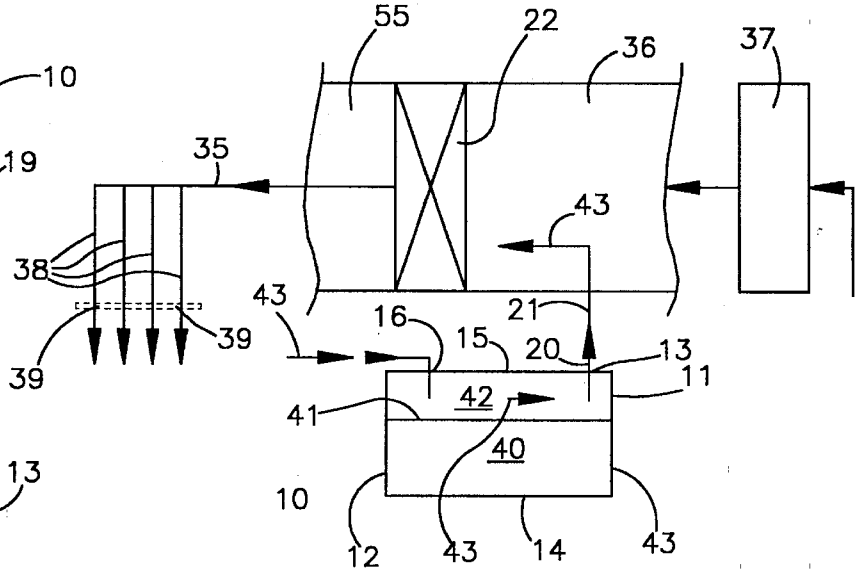
FIG. 4: A system for enrichment of ventilation or air-conditioning air with fragrances, schematic sketch.

In the area of the other narrow side of the vessel 11 there is a single (in the figure), circular air exhaust opening 19, that can be connected via a pipe support 20 and a pipeline 21 to the suction line of a fan 22 (FIG. 4).

The vessel 11 can be filled with a dilution liquid, in particular water, via a centrally positioned opening 23. To do this, a spray head 24 is used that can produce a broadly fanned dilution cone 25. By means of a magnet valve 26, the dilution liquid can be added at specified times and in preset quantities.

Via at least one (in FIG. 3, two) additional opening 27 and corresponding connection lines 28, the vessel 11 can be filled with fragrance or fragrance concentrate from a supply vessel 29. The exact mixing ratio is adjustable by means of a pump 30, such as magnetic dosing pump.

At the lowest point of the base tub 14, which can also be inclined to one side (not actually shown in the figures), a drain opening 31 is provided that can be opened and closed by means of a magnet valve 32.

All time functions can be triggered by means of at least one time clock 33.

The electrical lines 34 connecting all the various electrically operable components together are not shown in detail (for simplicity), since they are already well known to the technician.

The time clock 33 can be designed, e.g., as a weekly timer and can switch on the various valves at the adjusted time on those days when the ventilation or air-conditioning air is to be enriched with fragrance. For instance, if the device 10, taken out of operation at night and drained, is taken into operation, the fresh water inlet will first be kept open for a preset time period, so that a portion of the water requirement will be sprayed into the vessel 11. Next, the dosing pump 30 will also be set in operation for a likewise preset time period. Finally, water will be added again until the desired quantity of water (e.g. 12 liters of water with 10 $cm^3$ of fragrance extract) is completed. Now, if the addition of fragrance is to be ended, e.g. in the evening, the vessel 11 will be drained automatically and then it will be sprayed with water for a predetermined amount of time with the magnet valve 32 opened (cleaning phase).

The operation of the system in progress is best illustrated in FIG. 4. At the beginning of pipe channel 35 (shown in sections) there is a fan 22 that sucks ventilation or air-conditioning air from the intake pipe 36. This air can flow via a known inlet unit 37 where it is cleaned, moistened, brought to correct temperature and/or treated in another manner. The pipe channel 35 branches off e.g. into air distribution channels 38 that open into air outlet slits 39 at various locations, e.g. in various rooms.

During operation of the system in the vessel 11 there is a mixture 40 of dilution liquid, fragrance concentrate and perhaps a known emulsifier. This mixture of liquid 40 forms a free surface (evaporation surface 41).

Due to the fluid connection between the gas space 42 of the vessel 11 and the intake pipe 36 of the fan 22, a subpressure develops in the gas space 42 of the vessel 11 which will generate an air flow 43 that is kept in motion. This bypass air passes over the evaporation surface 41 and leads to an exceptionally uniform carry-off of fragrance from vessel 11 and a correspondingly uniform enrichment of ventilation or air-conditioning air with this fragrance.

Now of course it is understood that the device 10 can also be equipped directly with a fan so that it can be used as a compact unit for ventilation of single rooms. Preferably the device will be connected to a (under some circumstances, already existing) ventilation or air-conditioning system in particular in the manner shown in FIG. 4.

It is understood that the device can also be connected to several supply vessels 29 for different fragrances, so that on different days or at different times on a single day different fragrance accents can be added into the ventilation or air-conditioning air.

Figure 5A:
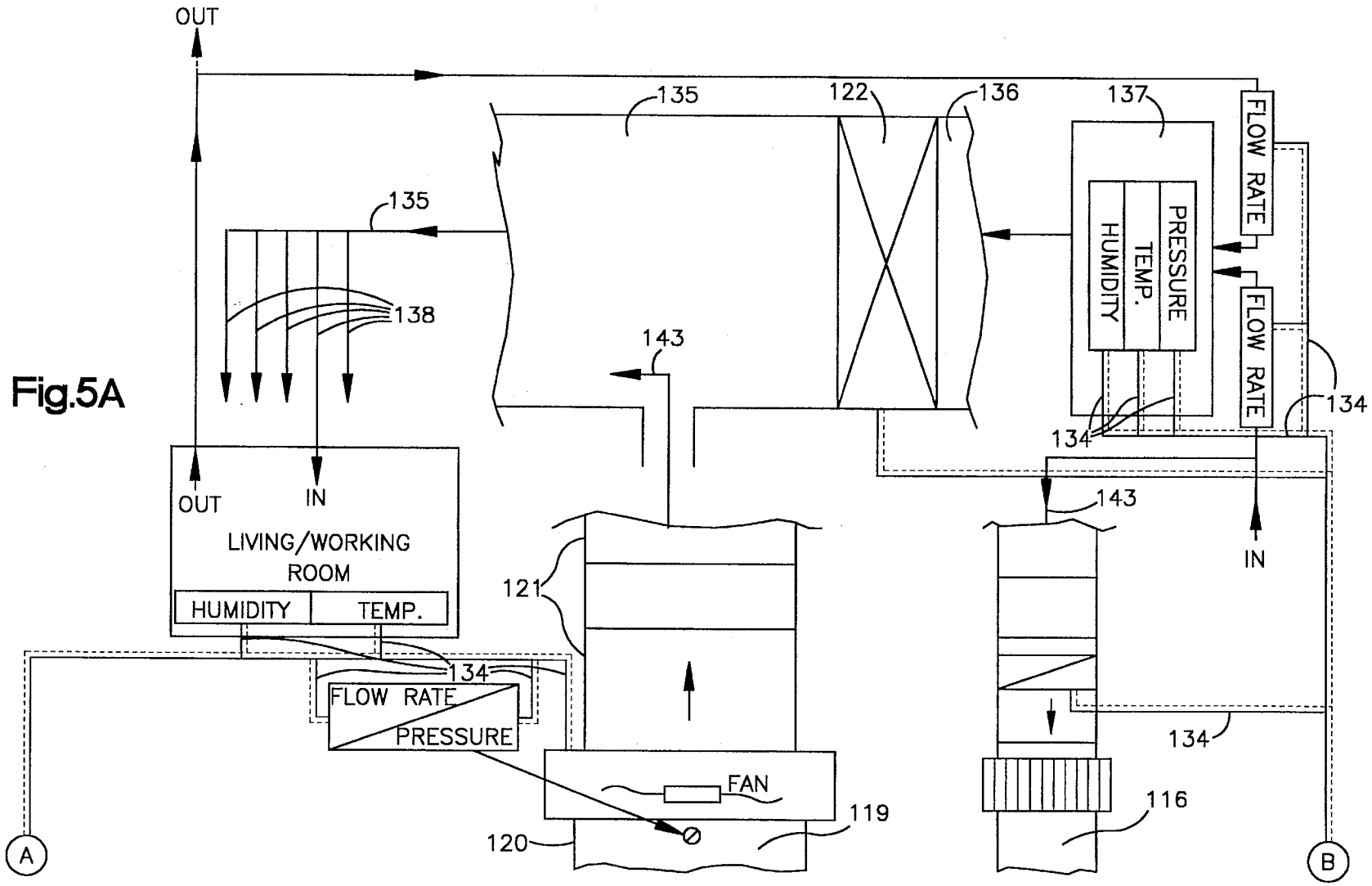
FIG. 5: A schematic sketch of another embodiment of the present invention.
Figure 5B:
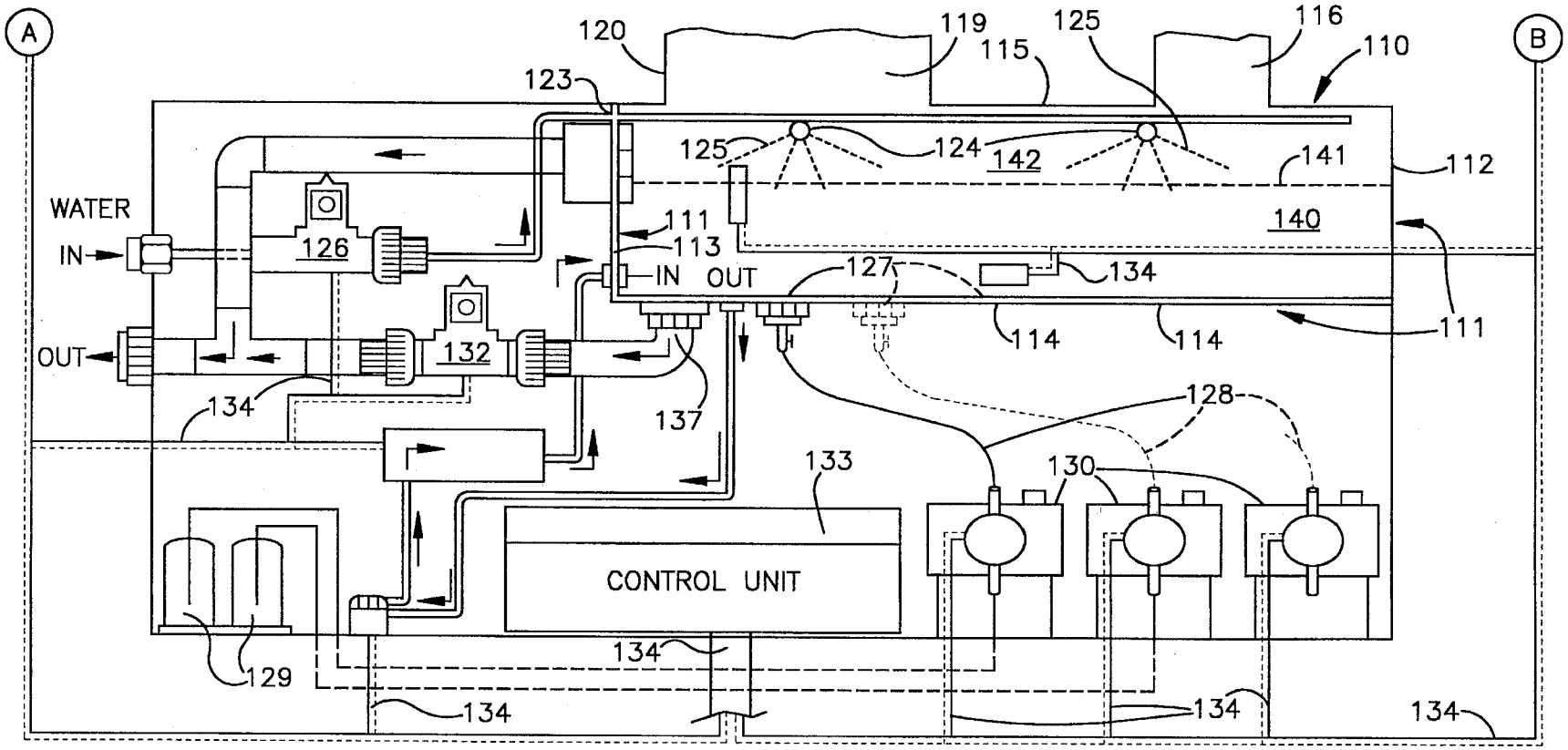

Another embodiment of the present invention is illustrated in FIG. 5. FIG. 5 shows a device 110 for the enrichment of ventilation or air-conditioning air with fragrances in a schematic view together with the whole system shown in FIG. 4. The device 110 has a vessel 111 that is surrounded by walls 112, 113, a cylindrical base tube 114 and a flat elongated cover plate 115. The cover 115 (which may be transparent if desired) has an air feed opening 116 at one end of the vessel 111.

Near the opposite end of the vessel 111, there is a circular opening 119 that is connected via a pipe 120 and a pipeline 121, which includes a noise damper, to a pipe channel 135. For purpose of clarity, the scale of the vessel 111 and other parts contained in a housing therefor is enlarged with respect to the pipe channel 135 and other parts which belong to the air-conditioning system.

The air-conditioning system comprises amongst others a well known inlet unit 137, an intake pipe 136, a fan 122, the pipe channel 135, air distribution channels 138 with outlet slits 139 leading into living or working rooms, and an air recirculation line conducting outlet air, which is not released to the atmosphere, back to the inlet unit 137.

The vessel 111 is filled with dilution liquid, e.g., water, via an opening 123 through the front wall 113 using at least one spray head 124 which can produce a broadly fanned dilution cone 125. By means of a magnet valve 126, the dilution liquid is added at specific times and in preset quantities.

Via at least one additional opening 127 in the bottom of the base tube 114 and corresponding connection lines 128, the vessel 111 can be filled with fragrance or fragrance concentrate from corresponding supply vessels 129. The exact mixing ratio is adjustable by means of a pump 130, such a magnetic dosing pump. The bottom of the base tube 114 declines towards one end where a drain opening 131 is provided that can be opened and closed by means of a magnet valve 132.

All time functions can be triggered by means of a time clock 133 which is part of a central control unit. Electrical lines 134 are connecting all the various electrically operable components being disclosed hereafter.

The device 110 is, in general, operated like the device 10 as explained with respect to the embodiment in FIGS. 1 to 4.

In order to control the operation of the whole system in response to sensored process data, there is further provided a maximum and a minimum level sensor which senses the height of the evaporation surface 141 of the mixture 140 contained in the vessel 111 and defines the lower end of the gas space 142 within the vessel 111. A circulation pump circulates and thereby also mixes the mixture 140 in the vessel 111 via connection pipes leading out from the bottom and leading into the side wall of the vessel 111. This mixture 140 is circulated via a heater which may be a continuous flow heater for controlling the temperature of mixture 140.

For controlling the air stream conducted over evaporation surface 141, a fan is provided in pipeline 121 and a volume control flap is provided at the air inlet side of the vessel 111.

The air flow rates from outdoors into the inlet unit 137 and the flow rates of the air recirculation line into the inlet unit are measured and—as all the other sensor data—fed via data lines 134 to the control unit which amongst others calculates also the ratio of outdoors air-conditioning air and recirculated air-conditioning air.

Further data which may be sensored are humidity, temperature and/or pressure in the inlet unit 137, humidity and/or temperature in the living or working rooms to be air-conditioned as well as flow rate and/or pressure of the outlet air of vessel 111.

As stated before, all other operations/functions of the system according to embodiment in FIG. 5 are similar to those described with respect to FIGS. 1 to 4 (the reference numerals of the different features being the same except a "100" being added in front of it).

From the above description of the invention, those skilled in the art will perceive improvements, changes and modifications. Such improvements, changes and modifications within the skill of the art are intended to be covered by the appended claims.

Having described the invention, the following is claimed:

1. A method for the enrichment of ventilation or air-conditioning air with a fragrance comprising the steps of:

providing a ventilation or air-conditioning air stream;

providing a mixture of a fragrance and a dilution liquid for the fragrance;

positioning the mixture in at least one vessel wherein the mixture has a free evaporation surface;

feeding an induced air flow across the free evaporation surface of the mixture for evaporation of fragrance from the mixture into the induced air flow;

combining the induced air flow with the ventilation or air-conditioning air stream in an amount which is a fraction of the ventilation or air-conditioning air stream; and controlling the quantity of the induced air flow across the free-evaporation surface per unit of time in response to sensored process data.

2. A method of claim 1 further comprising the step of controlling the temperature of the mixture in the vessel to maintain the temperature at a selectable value above room temperature.

3. A method of claim 1 wherein the vessel is filled with mixture according to the sequence of:

(a) adding a portion of the dilution liquid;

(b) adding fragrance; and (c) adding the remainder of the dilution liquid.

4. A method of claim 1 including the steps of:

(a) controlling the flow of dilution liquid into the vessel by means of a valve; and (b) controlling the flow of fragrance into the vessel by means of a pump.

5. A method of claim 1 including the step of adding the dilution liquid to the vessel by means of a spray.

6. A method for the enrichment of ventilation or air-conditioning air with a fragrance comprising the steps of:

providing a ventilation or air-conditioning air stream;

providing a mixture of a fragrance and a dilution liquid for the fragrance;

positioning the mixture in at least one vessel wherein the mixture has a free evaporation surface;

feeding an induced air flow across the free evaporation surface of the mixture for evaporation of fragrance from the mixture into the induced air flow; and redosing the vessel with the mixture at selectable time points in response to sensored process data by (i) first draining old mixture still contained in the vessel out of the vessel, (ii) cleaning the vessel, and (iii) then dosing both fresh dilution liquid and fresh fragrance into the vessel.

7. A method of claim 6 further comprising the step of controlling the temperature of the mixture in the vessel to maintain the temperature at a selectable value above room temperature.

8. A method of claim 6 wherein the vessel is filled with mixture according to the sequence of:

(a) adding a portion of the dilution liquid;

(b) adding fragrance; and (c) adding the remainder of the dilution liquid.

9. A method of claim 6 including the steps of:

(a) controlling the flow of dilution liquid into the vessel by means of a valve; and (b) controlling the flow of fragrance into the vessel by means of a pump.

10. A method of claim 6 including the step of adding the dilution liquid to the vessel by means of a spray.

11. A method for the enrichment of ventilation or air-conditioning air with a fragrance comprising the steps of:

providing a ventilation or air-conditioning air stream;

providing a mixture of a fragrance and a dilution liquid for the fragrance;

positioning the mixture in at least one vessel wherein the mixture has a free evaporation surface;

feeding an induced air flow across the free evaporation surface of the mixture for evaporation of fragrance from the mixture into the induced air flow; and at least one vessel contains the fragrance only during time periods and/or that it contains different fragrances during different partial time periods by the use of several containers.

12. A method of claim 11 further comprising the step of controlling the temperature of the mixture in the vessel to maintain the temperature at a selectable value above room temperature.

13. A method of claim 11 wherein the vessel is filled with mixture according to the sequence of:

(a) adding a portion of the dilution liquid;

(b) adding fragrance; and (c) adding the remainder of the dilution liquid.

14. A method of claim 11 including the steps of:

(a) controlling the flow of dilution liquid into the vessel by means of a valve; and (b) controlling the flow of fragrance into the vessel by means of a pump.

15. A method of claim 11 including the step of adding the dilution liquid to the vessel by means of a spray.

16. A method for the enrichment of ventilation or air-conditioning air with a fragrance comprising the steps of:

providing a ventilation or air-conditioning air stream;

providing a mixture of a fragrance and a dilution liquid for the fragrance;

positioning the mixture in at least one vessel wherein the mixture has a free evaporation surface;

feeding an induced air flow across the free evaporation surface of the mixture for evaporation of fragrance from the mixture into the induced air flow;

combining the induced air flow with the ventilation or air-conditioning air stream in an amount which is a fraction of the ventilation or air-conditioning air stream;

controlling the quantity of the induced air flow across the free-evaporation surface per unit of time in response to sensored process data;

redosing the vessel with the mixture at selectable time points in response to sensored process data by (i) first draining old mixture still contained in the vessel out of the vessel, (ii) cleaning the vessel, and (iii) then dosing both fresh dilution liquid and fresh fragrance into the vessel; and controlling the temperature of the mixture in the vessel to maintain the temperature at a selectable value above room temperature.

17. A system for the enrichment of ventilation or air-conditioning air with a fragrance, said system comprising:

a circuit for the ventilation or air-conditioning air;

at least one vessel containing a mixture of fragrance and dilution liquid, said mixture defining a free evaporation surface in said vessel;

a first fluid inlet means including a valve connected to said vessel for introducing fresh dilution liquid into said vessel;

a second fluid inlet means including a pump connected to said vessel for introducing fresh fragrance into said vessel;

means for inducing an air flow across said free evaporation surface;

means for combining said induced air flow with the ventilation or air conditioning air;

means for draining old mixture still contained in said vessel out of said vessel;

means for cleaning said vessel after said vessel has been drained;

means responsive to sensored process data for controlling said draining means, said cleaning means, and said first and second fluid inlet means to first drain and clean said vessel and then to dose both fresh dilution and fresh fragrance into said vessel after said vessel has been drained and cleaned; and means for controlling the temperature of said mixture in said vessel to maintain the temperature at a selectable value above room temperature.

18. The system of claim 17 further including means for spraying said dilution liquid into said vessel.

19. The system of claim 17 further including an air inlet in said vessel, an air outlet in said vessel, and an exhaust fan having an inlet side, said air outlet being connected to said inlet side of said exhaust fan to provide said induced air flow.

20. The system of claim 19 wherein said air outlet is connected to the ventilation or air-conditioning air circuit.

21. A system for the enrichment of ventilation or air-conditioning air with fragrance, said system comprising:

at least one vessel containing a mixture of fragrance and diluting liquid, said mixture defining a free evaporation surface in said vessel;

at least one pump connected in fluid communication with said vessel for automatic dosing of fragrance into said vessel;

at least one valve connected in fluid communication with said vessel for automatic dosing of dilution fluid into said vessel;

said vessel including (i) means defining at least one inlet air opening and (ii) means defining at least one outlet air opening;

a fan having an intake side for ventilation or air-conditioning air;

means responsive to sensored process data for connecting said at least one outlet air opening in said vessel in fluid communication with said intake side of said fan to allow said fan to induce an air flow through said at least one inlet air opening across said free evaporation surface and then through said at least one outlet air opening to enrich the ventilation or air-conditioning air at said intake side of said fan with fragrance.

22. A system according to claim 21 wherein said mixture in said vessel includes an emulsifier.

23. A system according to claim 21 wherein said diluting liquid in said vessel includes water.

* * * * *